US011002291B2

(12) United States Patent
Yokoyama et al.

(10) Patent No.: US 11,002,291 B2
(45) Date of Patent: May 11, 2021

(54) COMPRESSOR IMPELLER

(71) Applicant: MITSUBISHI HEAVY INDUSTRIES ENGINE & TURBOCHARGER, LTD., Sagamihara (JP)

(72) Inventors: Takao Yokoyama, Tokyo (JP); Yutaka Fujita, Tokyo (JP)

(73) Assignee: MITSUBISHI HEAVY INDUSTRIES ENGINE & TURBOCHARGER, LTD., Sagamihara (JP)

( * ) Notice: Subject to any disclaimer, the term of this patent is extended or adjusted under 35 U.S.C. 154(b) by 210 days.

(21) Appl. No.: 16/088,229

(22) PCT Filed: Mar. 30, 2016

(86) PCT No.: PCT/JP2016/060468
§ 371 (c)(1),
(2) Date: Sep. 25, 2018

(87) PCT Pub. No.: WO2017/168648
PCT Pub. Date: Oct. 5, 2017

(65) Prior Publication Data

US 2020/0166052 A1 May 28, 2020

(51) Int. Cl.
*F04D 29/58* (2006.01)
*F04D 29/02* (2006.01)
*F04D 29/28* (2006.01)

(52) U.S. Cl.
CPC ..... *F04D 29/5853* (2013.01); *F04D 29/023* (2013.01); *F04D 29/284* (2013.01);
(Continued)

(58) Field of Classification Search
CPC .. F04D 29/5853; F04D 29/023; F04D 29/284; F04D 29/58; F05C 2251/048; F05D 2240/15; F05D 2250/141
See application file for complete search history.

(56) References Cited

U.S. PATENT DOCUMENTS 4,620,833 A 11/1986 Townsend
5,403,150 A * 4/1995 McEachern, Jr. ..... F01D 25/125 384/478

(Continued)

FOREIGN PATENT DOCUMENTS

CN 102959248 A 3/2013
DE 4417095 A1 11/1995

(Continued)

OTHER PUBLICATIONS

Extended European Search Report dated Mar. 6, 2019, for corresponding European Patent Application No. 16896867.5.

(Continued)

*Primary Examiner* — Aaron R Eastman
(74) *Attorney, Agent, or Firm* — Birch, Stewart, Kolasch & Birch, LLP

(57) ABSTRACT

A compressor impeller includes: a compressor impeller body portion including a boss portion and a plurality of vane portions disposed at intervals in a circumferential direction on a peripheral surface of the boss portion; and a heat shield portion disposed on a side of a back surface of the boss portion and configured to rotate with the compressor impeller body portion.

8 Claims, 8 Drawing Sheets

(52) U.S. Cl.
CPC .... *F05C 2251/048* (2013.01); *F05D 2240/15* (2013.01); *F05D 2250/141* (2013.01)

(56) References Cited

U.S. PATENT DOCUMENTS

| | | | | |
|---|---|---|---|---|
| 8,590,150 | B2 | 11/2013 | Pham et al. | |
| 2009/0226307 | A1* | 9/2009 | Masson | F02C 6/12 415/177 |
| 2009/0246005 | A1 | 10/2009 | Eble et al. | |
| 2010/0215506 | A1 | 8/2010 | Heyes et al. | |
| 2013/0078082 | A1* | 3/2013 | Arnold | F02C 6/12 415/159 |
| 2018/0045106 | A1* | 2/2018 | Musil | F01D 25/24 |

FOREIGN PATENT DOCUMENTS

| | | | |
|---|---|---|---|
| EP | 0518027 | A1 | 12/1992 |
| JP | 10-54391 | A | 2/1998 |
| JP | 2934530 | B2 | 8/1999 |
| JP | 2013-147984 | A | 8/2013 |
| JP | 2014-211127 | A | 11/2014 |

OTHER PUBLICATIONS

Office Action dated Jul. 23, 2019 issued to the corresponding Japanese Application No. 2018-507951.
International Preliminary Report on Patentability and Written Opinion of the International Searching Authority (Forms PCT/IB/338, PCT/IB/373, PCT/ISA/237 and PCT/IB/326) for Application No. PCT/JP2016/060468, dated Oct. 11, 2018, with an English translation.
International Search Report for Application No. PCT/JP2016/060468 (Form PCT/ISA/210), dated Jun. 28, 2016.
Office Action dated Oct. 23, 2019 issued in the corresponding Japanese Application No. 2018-507951 with an English Translation.
Office Action dated Nov. 14, 2019 issued to the corresponding European Application No. 16896867.5.
Office Action dated Nov. 4, 2019 in the corresponding Chinese Application No. 201680083692.8 with a Machine Translation.

* cited by examiner

COMPRESSOR IMPELLER

TECHNICAL FIELD

The present disclosure relates to a compressor impeller.

BACKGROUND ART

Normally, the compressor impeller includes a boss portion, and a plurality of vane portions disposed at intervals in the circumferential direction on the peripheral surface of the boss portion.

FIG. 7 is a diagram showing the distribution of air temperature on the front side (the side where the vanes 004 are provided) of the boss portion 002 of the compressor impeller 050, during operation of the compressor used for the turbocharger. FIG. 8 is a diagram showing the distribution of air temperature in the gap on the back side (the gap in the axial direction between the back side of the boss portion and the stationary portion of the casing or the like) of the boss portion 002 of the compressor impeller 050, during operation of the compressor. FIG. 9 is a diagram showing the distribution of the metal temperature of the compressor impeller 050 during operation of the compressor. FIGS. 7 to 9 are diagrams schematically showing the result of thermal analysis by the present inventors, which are not known at the time of filing of the present application.

As shown in FIG. 7, the temperature of air compressed by the compressor impeller 050 increases, and thus the air temperature on the discharge side (outer side in the radial direction) of the compressor impeller 050 is higher than the air temperature on the intake side (inner side in the radial direction) of the compressor impeller 050. Furthermore, a part of discharge air flows into the gap on the back side of the boss portion 002. Thus, as shown in FIG. 8, the air in the gap is heated further by friction loss with the back surface 002*b* of the boss portion 002, and heats the back surface 002*b* of the boss portion 002.

As shown in FIG. 9, as the temperature of the back surface 002*b* of the boss portion 002 increases due to the friction loss, the temperatures of the entire boss portion 002 and the vane portions 004 disposed around the boss portion 002 increase due to heat transmission from the back surface 002 of the boss portion 002 to the front side (compressor inlet side) of the boss portion 002. Thus, the air flowing along the compressor impeller 050 is heated from heat transmission from the boss portion 002 and the vane portion 004 (in particular, heat transmission at the compressor inlet side where the temperature difference between the air and the compressor impeller 050 tends to increase), thus obtaining an increased temperature.

When the temperature of the air flowing along the compressor impeller 050 is increased from heat transmission from the boss portion 002 and the vane portion 004, it leads to deterioration of the performance of the compressor impeller 050, that is, reduction of the compressor pressure ratio and reduction of the compressor efficiency.

In the compressor disclosed in Patent Document 1, high-pressure cooling gas is sprayed onto the back surface of the boss portion of the compressor impeller to cool the back surface of the boss portion, and the compressor efficiency is improved.

CITATION LIST

Patent Literature

Patent Document 1: JP2934530B

SUMMARY

Problems to be Solved

For the compressor disclosed in Patent Document 1, it is necessary to provide a supply flow passage for the cooling gas on the side of the casing for accommodating the compressor impeller, and thus the casing has a complex structure. In particular, for small-sized compressors used for automobile turbochargers or the like, it is often difficult to provide a casing with a supply flow passage for cooling gas.

The present invention was made in view of the above problem, and an object is to provide a compressor impeller whereby it is possible to suppress a temperature increase of a back surface of a boss portion of a compressor impeller, while preventing the configuration of the casing side from becoming complex.

Solution to the Problems (1) According to at least one embodiment of the present invention, a compressor impeller includes: a compressor impeller body portion including a boss portion and a plurality of vane portions disposed at intervals in a circumferential direction on a peripheral surface of the boss portion; and a heat shield portion disposed on a side of a back surface of the boss portion and configured to rotate with the compressor impeller body portion.

According to the above compressor impeller (1), with the heat shield portion that rotates with the compressor impeller body portion, it is possible to suppress a temperature increase of the back surface of the boss portion due to friction between the back surface of the boss portion and air. Accordingly, it is possible to reduce the amount of heat transmitted to the front side (compressor inlet side) of the boss portion from the back surface of the boss portion, and suppress a temperature increase of the boss portion and the vane portion disposed on the peripheral surface of the boss portion. Thus, it is possible to suppress heating of the air flowing along the compressor impeller body portion from heat transmission from the boss portion and the vane portion (in particular, heat transmission at the compressor inlet side where the temperature difference between the air and the compressor impeller body portion tends to increase), and thus it is possible to obtain a highly-efficient compressor impeller whereby it is possible to suppress reduction of the compressor pressure ratio and the compressor efficiency.

Furthermore, like the compressor disclosed in Patent Document 1, it is unnecessary to provide a supply flow passage for the cooling gas on the side of the casing for accommodating the compressor impeller, and thus it is possible to prevent the configuration of the casing from becoming complex.

(2) In some embodiments, in the above compressor impeller (1), the heat shield portion is made of a different material from the compressor impeller body portion.

According to the above compressor impeller (2), by using a suitable material for the heat shield portion, it is possible to effectively suppress a temperature increase of the back surface of the boss portion due to friction between the back surface of the boss portion and air.

(3) In some embodiments, in the above compressor impeller (2), the heat shield portion is made of a material having a lower thermal conductivity than the compressor impeller body portion.

With the above compressor impeller (3), even if the air opposite to the heat shield portion across the boss portion is heated from friction with the heat shield portion in rotation, the heat shield portion formed of a material having a lower thermal conductivity than the compressor impeller body portion suppresses heat transmission from the air toward the boss portion. Thus, it is possible to suppress heating of the back surface of the boss portion effectively.

(4) In some embodiments, in the compressor impeller according to any one of the above (1) to (3), the heat shield portion is made of sheet metal.

With the above compressor impeller (4), it is possible to achieve a light-weight heat shield portion at low cost.

(5) In some embodiments, in the compressor impeller according to any one of the above (1) to (4), the heat shield portion is disposed so as to face the back surface of the boss portion via a gap.

According to the above compressor impeller (5), the compressor impeller body portion and the heat shield portion rotate together, and thereby it is possible to rotate the air in the gap interposed between the back surface of the boss portion and the heat shield portion, with the back surface of the boss portion and the heat shield portion. That is, it is possible to make the air in the gap 'g' rotate together with the back surface 2*b* of the boss portion 2 and the heat shield portion 8 in rotation. Thus, the friction between the back surface of the boss portion and the air in the gap is small, and the temperature of the air in the gap is less likely to rise. Thus, it is possible to suppress heating of the back surface of the boss portion effectively.

(6) In some embodiments, in the above compressor impeller (2) or (3), the heat shield portion includes a coating layer coating the back surface of the boss portion, the coating layer being formed of a material having a lower thermal conductivity than the compressor impeller body portion.

With the above compressor impeller (6), it is possible to achieve a light-weight heat shield portion at low cost.

(7) In some embodiments, in the above compressor impeller (1), the heat shield portion is formed integrally with the compressor impeller body portion from an identical material, and a slit is disposed between the heat shield portion and the boss portion.

According to the above description (7), the compressor impeller body portion and the heat shield portion rotate together, and thereby it is possible to rotate the air in the slit between the boss portion and the heat shield portion, with the back surface of the boss portion and the heat shield portion. Thus, the friction between the back surface of the boss portion and the air in the slit is small, and the temperature of the air in the slit is less likely to rise. Thus, it is possible to suppress heating of the back surface of the boss portion effectively. Furthermore, since the heat shield portion is formed integrally with the compressor impeller body portion from the same material, the heat shield portion can be provided without increasing the number of components, which makes it possible to suppress a size increase and a cost increase of the compressor impeller.

(8) In some embodiments, in the compressor impeller according to any one of the above (1) to (7), the heat shield portion is formed to have an annular shape.

According to the above compressor impeller (8), the heat shield portion is formed over the entire region in the circumferential direction of the compressor impeller, and thus it is possible to suppress heating of the back surface of the boss portion due to friction between the back surface of the boss portion and air effectively with the heat shield portion.

(9) In some embodiments, in the above compressor impeller (8), a distance between a radially outer end of the heat shield portion and a rotational axis of the compressor impeller is not smaller than a half of a distance between a radially outer end of the back surface of the boss portion and the rotational axis of the compressor impeller.

According to the above compressor impeller (9), it is possible to effectively suppress a temperature increase due to friction with air, for the radially outer portion of the back surface of the boss portion, where the temperature tends to rise, with the heat shield portion.

(10) In some embodiments, in the above compressor impeller (8) or (9), the heat shield portion is formed integrally with the compressor impeller body portion from an identical material, a slit is disposed between the heat shield portion and the boss portion, and a radially outer end of the heat shield portion is positioned on an inner side of a radially outer end of the back surface of the boss portion in a radial direction of the compressor impeller.

According to the above compressor impeller (10), the compressor impeller body portion and the heat shield portion rotate together, and thereby it is possible to rotate the air in the slit between the boss portion and the heat shield portion, with the back surface of the boss portion and the heat shield portion. Thus, the friction between the back surface of the boss portion and the air in the slit is small, and the temperature of the air in the slit is less likely to rise. Thus, it is possible to suppress heating of the back surface of the boss portion effectively.

According to findings of the present inventors, the temperature of air adjacent to the back surface of the boss portion becomes highest at a radial directional position on the inner side of the radially outer end of the boss portion.

In this regard, with the compressor impeller (10), the radially outer end of the heat shield portion is disposed on the inner side, with respect to the radial direction, of the radially outer end of the back surface of the boss portion, and thus it is possible to provide the slit from the outer side to the inner side of the radial directional position with the highest temperature, without increasing the depth of the slit excessively in view of the strength of the compressor impeller. Thus, it is possible to suppress a temperature increase of the back surface of the boss portion effectively while ensuring the strength of the compressor impeller.

(11) In some embodiments, in the compressor impeller according to any one of the above (8) to (10), the heat shield portion is disposed so as to face the back surface of the boss portion via a gap, and the heat shield portion includes a curved portion having an annular shape and curved so as to become closer to the back surface of the boss portion outward in a radial direction of the compressor impeller.

According to the above compressor impeller (11), the heat shield portion facing the back surface of the boss portion via gap has a curved portion having an annular shape which is curved toward the back surface of the boss portion outward in the radial direction of the compressor impeller. Thus, air is more likely to be retained on the radially inner side of the curved portion having an annular shape, and the air in the gap is more likely to rotate with the boss portion and the heat shield portion. Thus, it is possible to effectively reduce the friction between the back surface of the boss portion and the air in the gap, and suppress a temperature increase of the air in the gap. Thus, it is possible to suppress heating of the back surface of the boss portion effectively.

(12) In some embodiments, in the compressor according to any one of the above (8) to (10), the heat shield portion is disposed so as to face the back surface of the boss portion via a gap, and the heat shield portion includes a protruding portion having an annular shape and protruding toward the back surface of the boss portion.

According to the above compressor impeller (12), the heat shield portion facing the back surface of the boss portion via a gap has a protruding portion having an annular shape which protrudes toward the back surface of the boss portion. Thus, air is retained on the inner side of the protruding portion having an annular shape, and the air in the gap is more likely to rotate with the boss portion and the heat shield portion. Thus, it is possible to effectively reduce the friction between the back surface of the boss portion and the air in the gap, and suppress a temperature increase of the air in the gap. Thus, it is possible to suppress heating of the back surface of the boss portion effectively.

Advantageous Effects

According to at least one embodiment of the present invention, it is possible to provide a compressor impeller whereby it is possible to suppress a temperature increase of a back surface of a boss portion of the compressor impeller, while preventing the configuration of the casing side from becoming complex.

DETAILED DESCRIPTION

Embodiments of the present invention will now be described in detail with reference to the accompanying drawings. It is intended, however, that unless particularly identified, dimensions, materials, shapes, relative positions and the like of components described in the embodiments shall be interpreted as illustrative only and not intended to limit the scope of the present invention.

For instance, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same" "equal" and "uniform" shall not be construed as indicating only the state in which the feature is strictly equal, but also includes a state in which there is a tolerance or a difference that can still achieve the same function.

Further, for instance, an expression of a shape such as a rectangular shape or a cylindrical shape shall not be construed as only the geometrically strict shape, but also includes a shape with unevenness or chamfered corners within the range in which the same effect can be achieved.

On the other hand, an expression such as "comprise", "include", "have", "contain" and "constitute" are not intended to be exclusive of other components.

Figure 1:
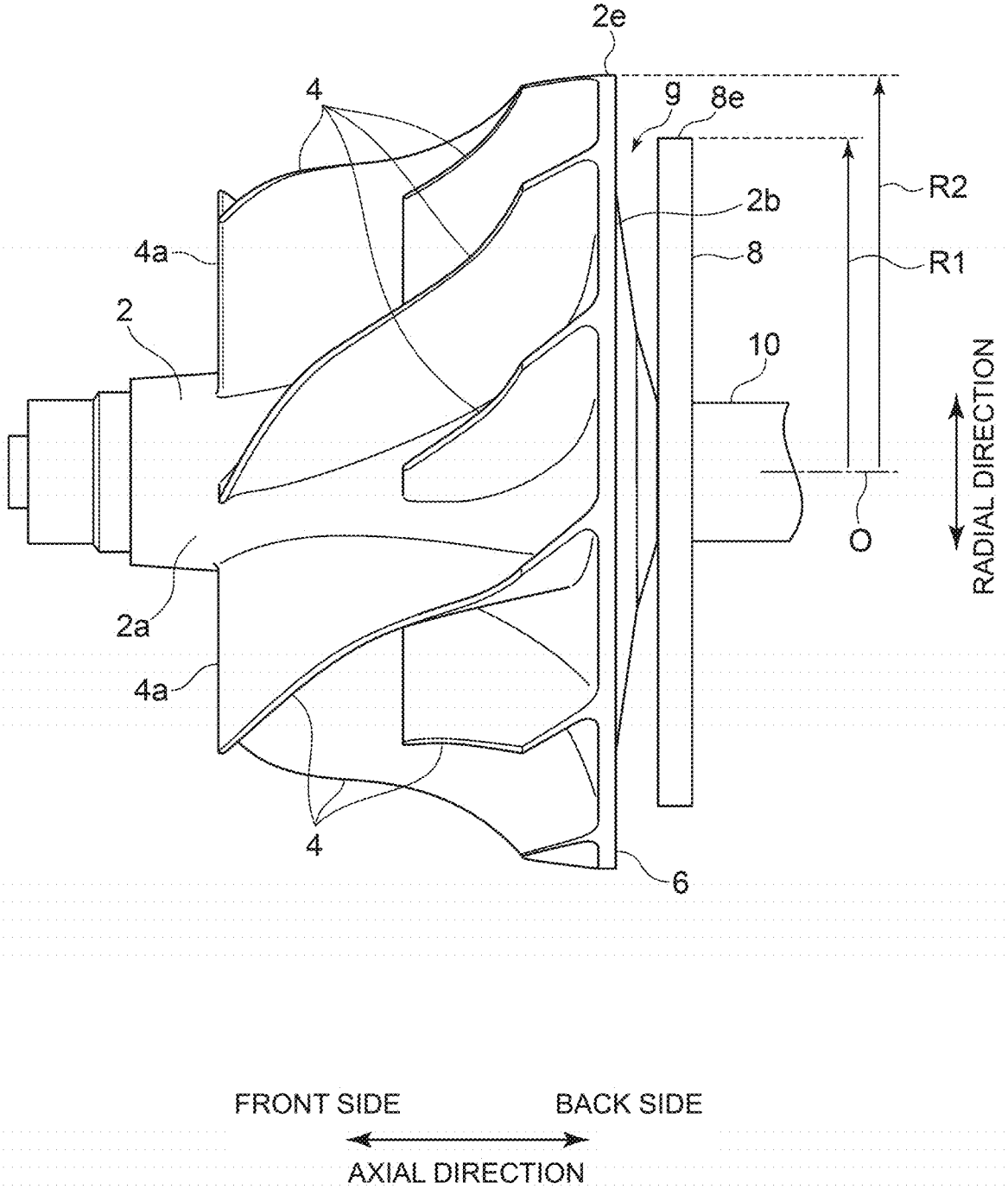
FIG. 1 is a side view of a compressor impeller 50 (50A) according to an embodiment of the present invention.
Figure 2:
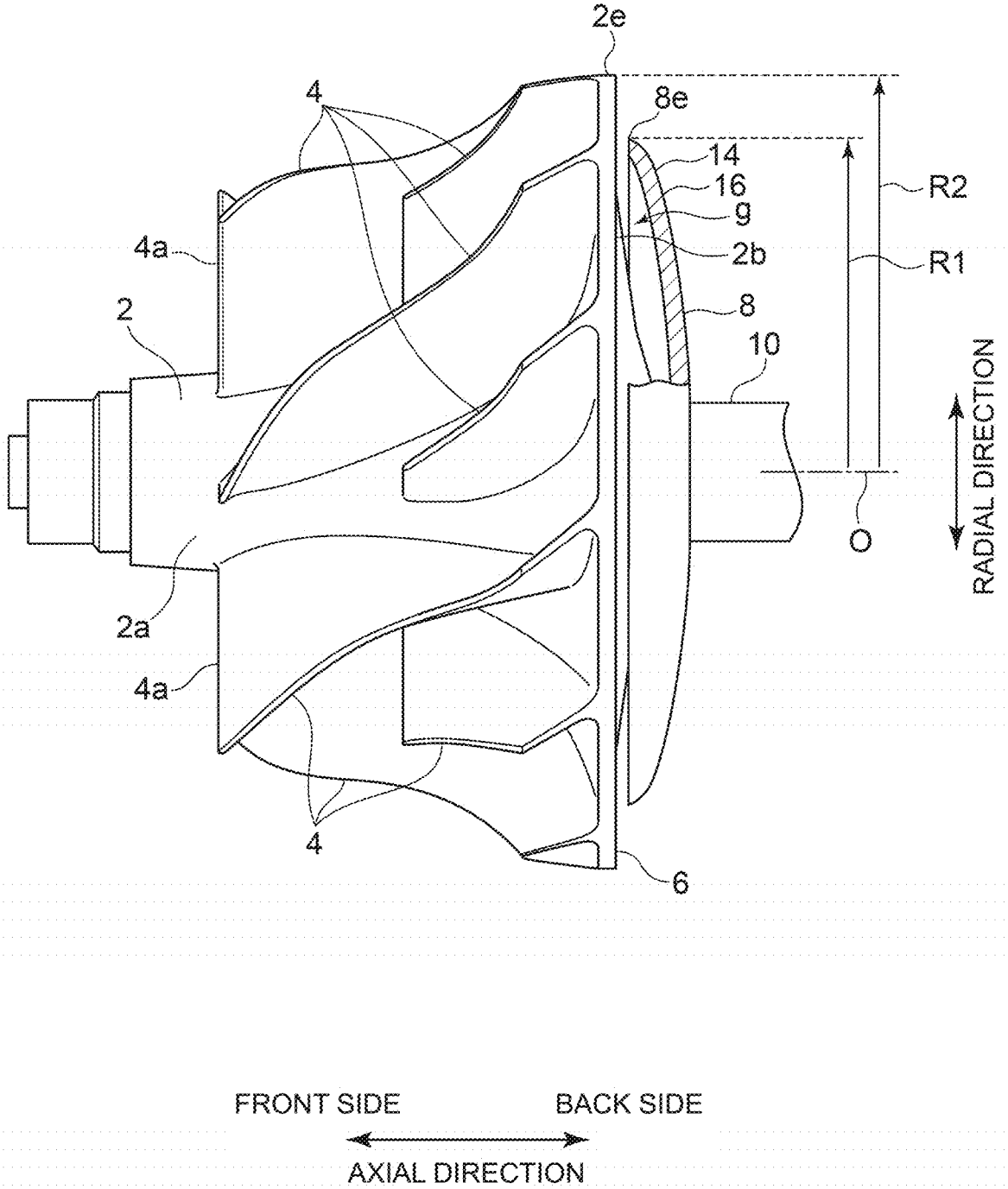
FIG. 2 is a side view of a compressor impeller 50 (50B) according to an embodiment of the present invention.
Figure 3:
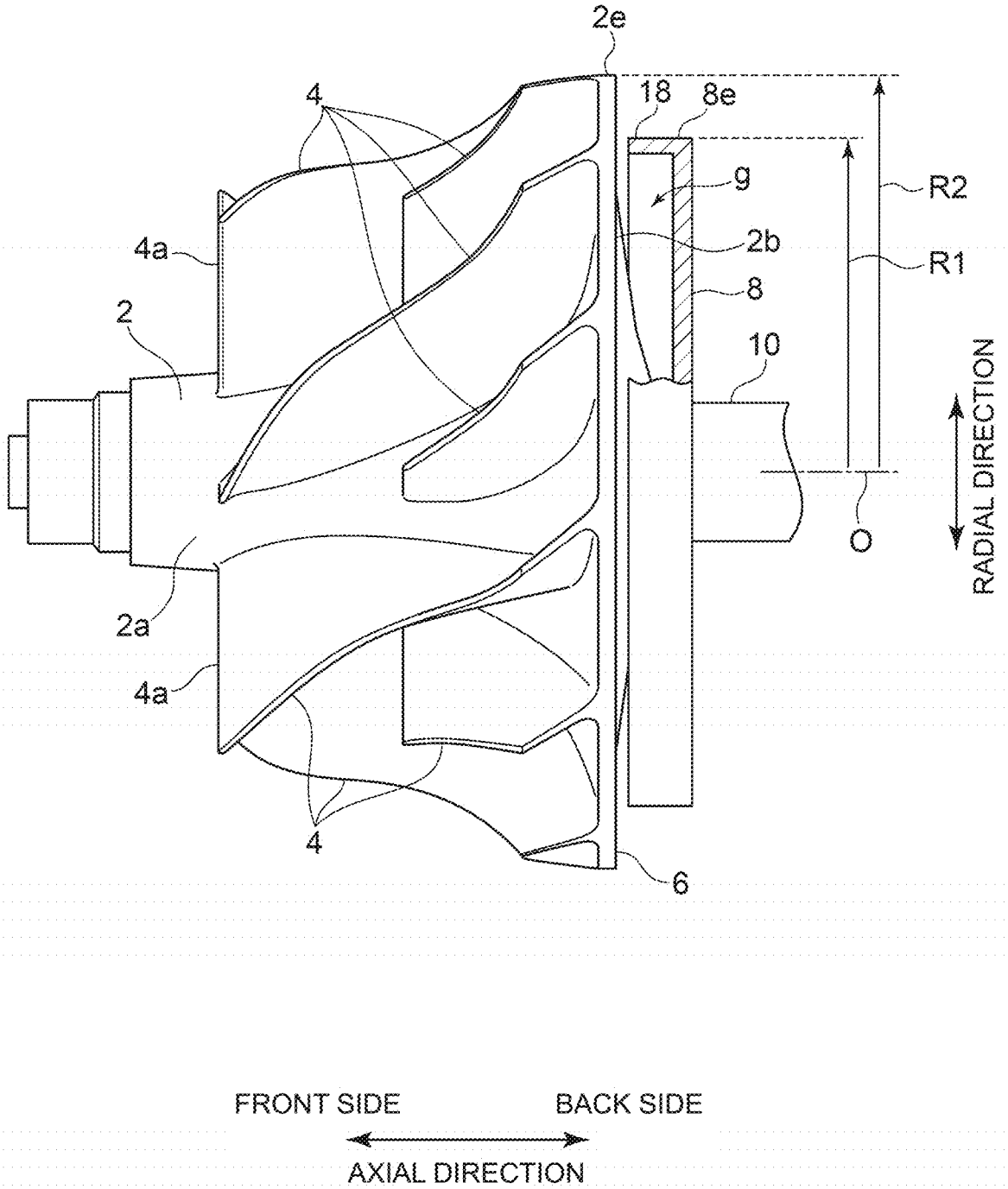
FIG. 3 is a side view of a compressor impeller 50 (50C) according to an embodiment of the present invention.
Figure 4:
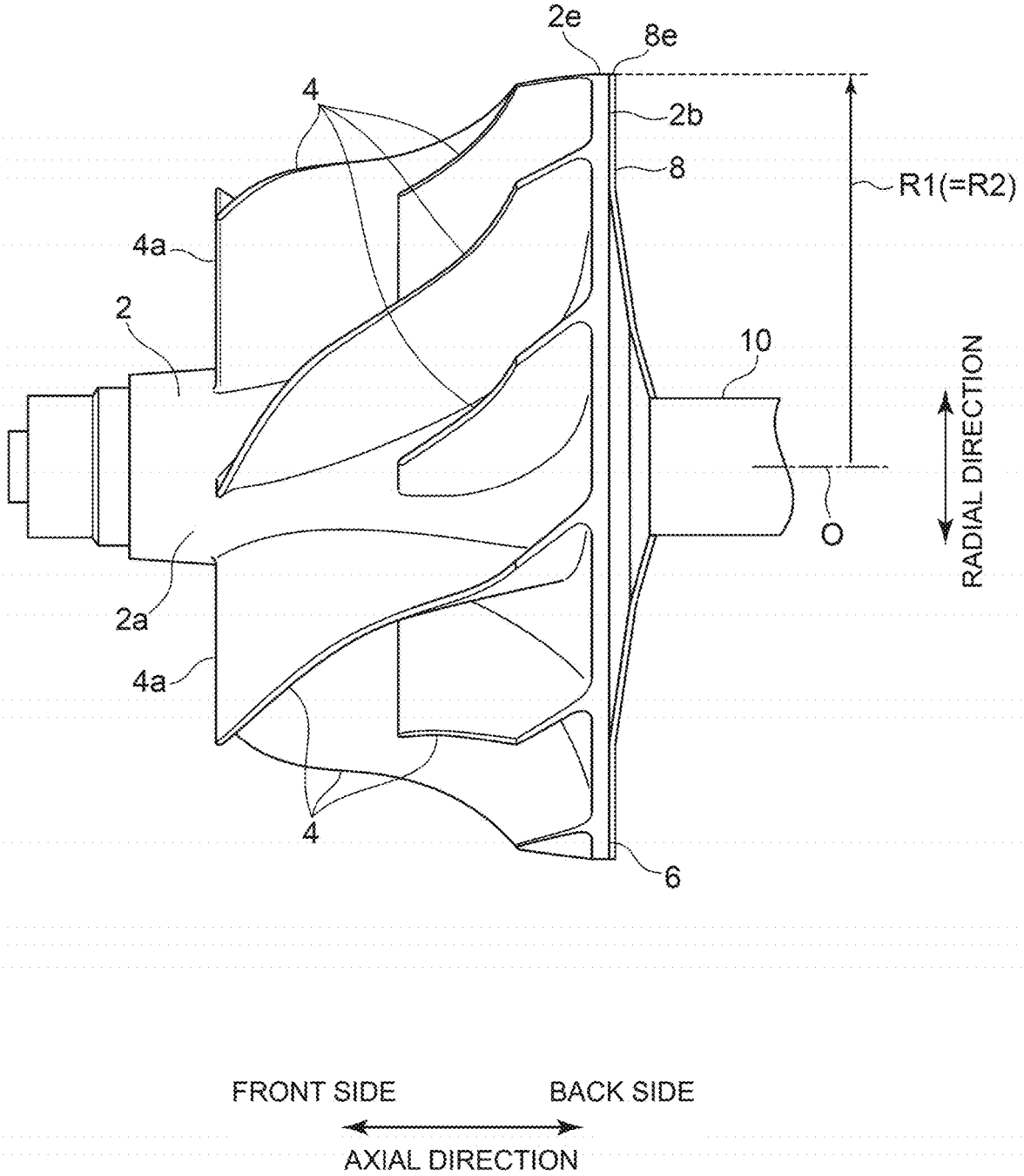
FIG. 4 is a side view of a compressor impeller 50 (50D) according to an embodiment of the present invention.
Figure 5:
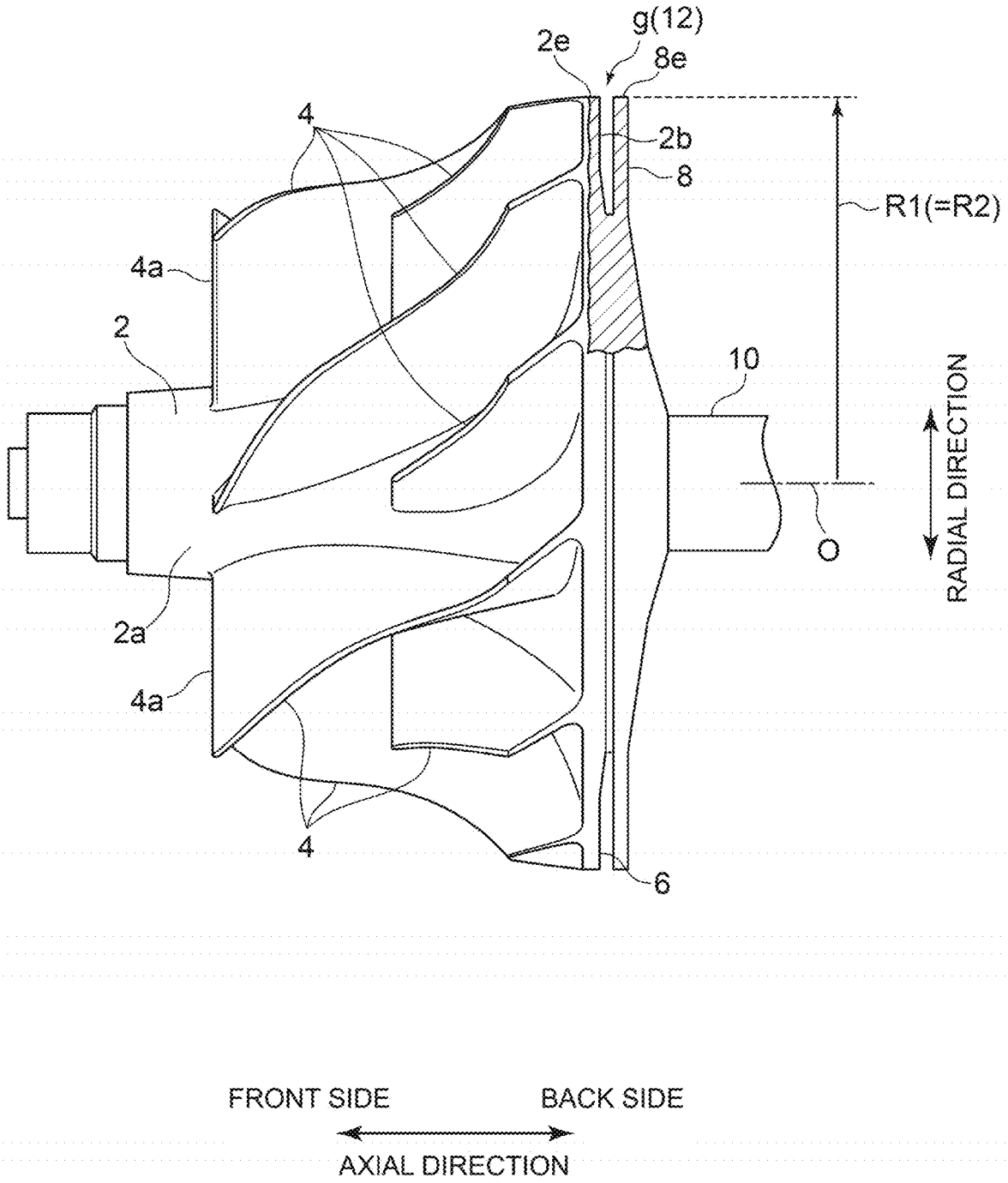
FIG. 5 is a side view of a compressor impeller 50 (50E) according to an embodiment of the present invention.
Figure 6:
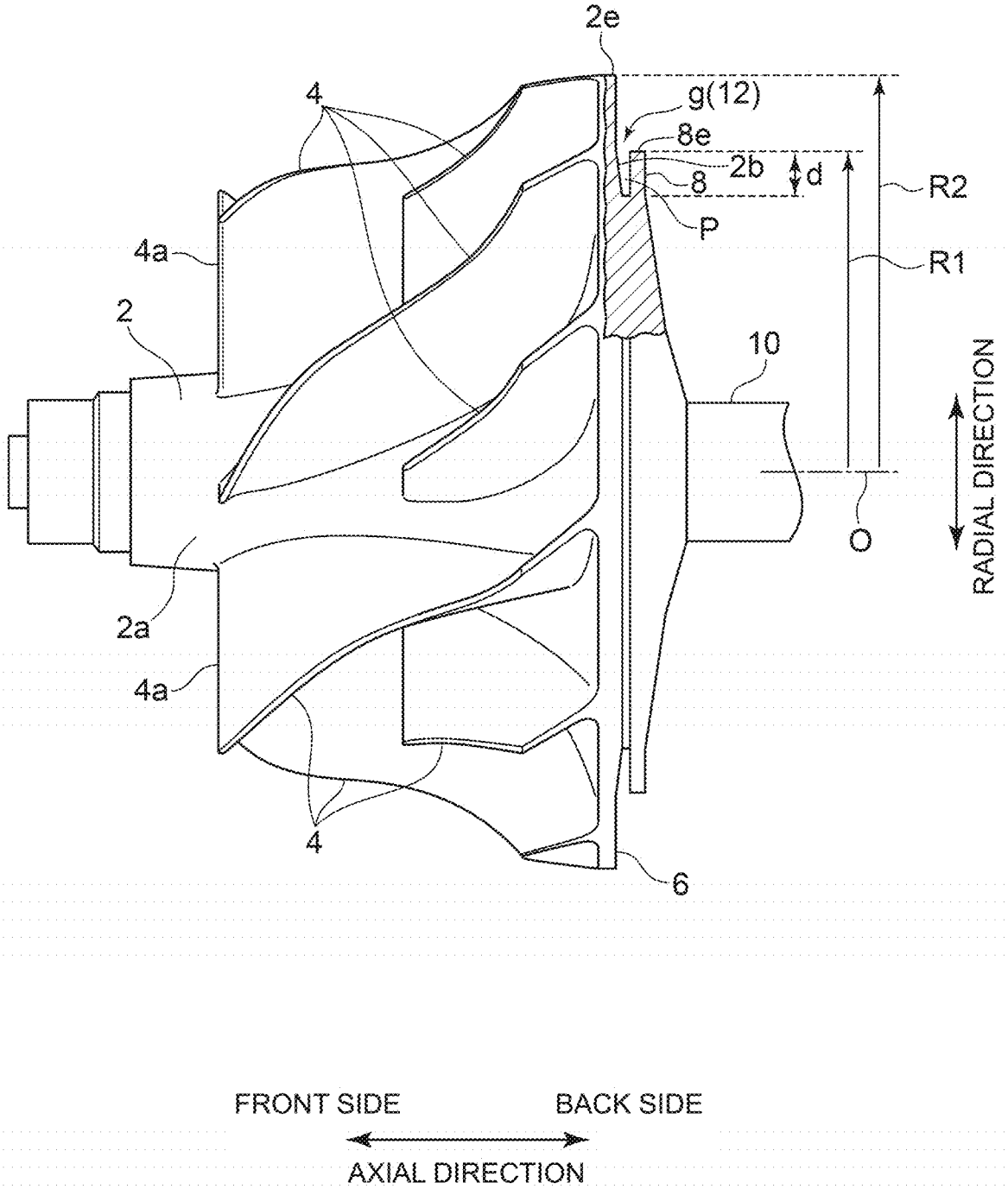
FIG. 6 is a side view of a compressor impeller 50 (50F) according to an embodiment of the present invention.
Figure 7:
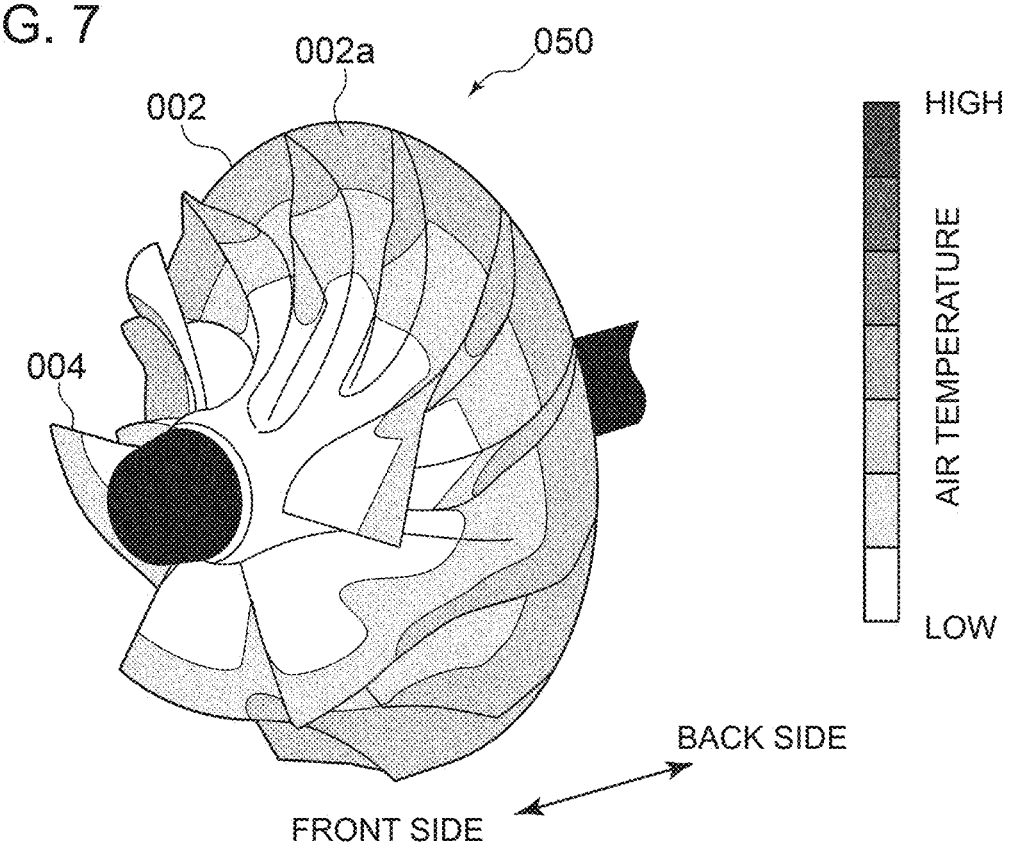
FIG. 7 is a diagram showing the distribution of air temperature on the front side (the side where the vanes 004 are provided) of the boss portion 002 of the compressor impeller 050, during operation of a compressor.

FIG. 1 is a side view of a compressor impeller 50 (50A) according to an embodiment of the present invention. FIG. 2 is a side view of a compressor impeller 50 (50B) according to an embodiment of the present invention. FIG. 3 is a side view of a compressor impeller 50 (50C) according to an embodiment of the present invention. FIG. 4 is a side view of a compressor impeller 50 (50D) according to an embodiment of the present invention. FIG. 5 is a side view of a compressor impeller 50 (50E) according to an embodiment of the present invention. FIG. 6 is a side view of a compressor impeller 50 (50F) according to an embodiment of the present invention.

Hereinafter, unless otherwise stated, the circumferential direction of the compressor impeller 50 is referred to as merely "circumferential direction", the radial direction of the compressor impeller 50 is referred to as merely "radial direction", and the axial direction of the compressor impeller 50 is referred to as merely "axial direction". Further, the compressor impeller 50 can be suitably used as a compressor for a small-sized turbocharger for automobiles, for instance.

In some embodiments, as shown in FIGS. 1 to 6 for instance, the compressor impeller 50 (50A to 50F) includes a shaft 10, a compressor impeller body portion 6 including a boss portion 2 (hub portion) mounted to the shaft 10 and a plurality of vane portions 4 disposed at intervals in the circumferential direction on the peripheral surface 2*a* of the boss portion 2, and a heat shield portion 8 disposed on the side of the back surface 2*b* of the boss portion 2 and configured to rotate with the compressor impeller body portion 6. The compressor impeller body portion 6 and the heat shield portion 8 are configured to rotate integrally with the shaft portion 10.

In the depicted embodiment, the heat shield portion 8 extends in the radial direction. Furthermore, in the compressor impeller 50 (50A to 50C) shown in FIGS. 1 to 3, the heat shield portion 8 is fixed to the shaft 10, and thereby configured to rotate with the compressor impeller body portion 6. In the compressor impeller 50 (50D to 50F) shown in FIGS. 4 to 6, the heat shield portion 8 is fixed to back surface 2*b* of the boss portion 2, and thereby configured to rotate with the compressor impeller body portion 6.

According to the above configuration, with the heat shield portion 8 that rotates with the compressor impeller body portion 6, it is possible to suppress heating of the back surface 2*b* of the boss portion 2 due to friction between the back surface 2*b* of the boss portion 2 and air. Accordingly, it is possible to reduce the amount of heat transmitted to the front side (compressor inlet side, that is, the side of the leading edge 4*a* of the vane portion 4) of the boss portion 2 from the back surface 2*b* of the boss portion 2, and suppress a temperature increase of the boss portion 2 and the vane portion 4 disposed on the peripheral surface 2*a* of the boss portion 2. Thus, it is possible to suppress heating of the air flowing along the compressor impeller body portion 6 from heat transmission from the boss portion 2 and the vane portion 4 (in particular, heat transmission at the compressor inlet side where the temperature difference between the air and the compressor impeller body portion 6 tends to increase), and thus it is possible to obtain a highly-efficient compressor impeller 50 whereby it is possible to suppress reduction of the compressor pressure ratio and the compressor efficiency.

Furthermore, like the compressor disclosed in Patent Document 1, it is possible to suppress a temperature increase of the back surface of the boss portion without providing a supply flow passage for the cooling gas on the side of the casing for accommodating the compressor impeller, and thus it is possible to prevent the configuration of the casing from becoming complex.

In some embodiments, in the compressor impeller 50 (50A to 50F) shown in FIGS. 1 to 6, the heat shield portion 8 is formed to have an annular shape around the shaft 10.

According to the above configuration, the heat shield portion 8 is formed over the entire region in the circumferential direction of the compressor impeller 50, and thus it is possible to suppress heating of the back surface 2*b* of the boss portion 2 due to friction between the back surface 2*b* of the boss portion 2 and air effectively with the heat shield portion 8.

In some embodiments, in the compressor impeller 50 (50A to 50D) shown in FIGS. 1 to 4, the heat shield portion 8 is formed of a different material from the compressor impeller body portion 6.

According to the above configuration, by using a suitable material for the heat shield portion 8, it is possible to effectively suppress a temperature increase of the back surface 2*b* of the boss portion 2 due to friction between the back surface 2*b* of the boss portion 2 and air.

In some embodiments, in the compressor impeller 50 (50A to 50D) shown in FIGS. 1 to 4, the heat shield portion 8 is formed of a material having a lower thermal conductivity than the compressor impeller body portion 6.

With the above configuration, even if the air opposite to the heat shield portion 8 across the boss portion 2 (the air adjacent to the right side of the heat shield portion 8 in the drawing) is heated from friction with the heat shield portion 8 in rotation, the heat shield portion 8 formed of a material having a lower thermal conductivity than the compressor impeller body portion 6 suppresses heat transmission from the air toward the boss portion 2. Thus, it is possible to suppress heating of the back surface 2*b* of the boss portion 2 effectively.

In some embodiments, in the compressor impeller 50 (50A, 50B) shown in FIGS. 1 and 2 for instance, the heat shield portion 8 is formed of sheet metal. According to the above configuration, it is possible to achieve a light-weight heat shield portion 8 at low cost.

In some embodiments, as depicted in FIGS. 1 to 3, 5, and 6, in the compressor impeller 50 (50A to 50C, 50E, 50F), the heat shield portion 8 is formed so as to face the back surface 2*b* of the boss portion 2 via a gap 'g'.

According to the above configuration, the compressor impeller body portion 6 and the heat shield portion 8 rotate together, and thereby it is possible to rotate the air in the gap 'g' interposed between the back surface 2*b* of the boss portion 2 and the heat shield portion 8, with the back surface 2*b* of the boss portion 2 and the heat shield portion 8. That is, it is possible to make the air in the gap 'g' rotate together with the back surface 2*b* of the boss portion 2 and the heat shield portion 8 in rotation. Thus, the friction between the back surface 2*b* of the boss portion 2 and the air in the gap 'g' is small, and the temperature of the air in the gap 'g' is less likely to rise. Thus, it is possible to suppress heating of the back surface 2*b* of the boss portion 2 effectively.

In some embodiments, as depicted in FIG. 1, in the compressor impeller 50 (50A), the heat shield portion 8 is formed to have a flat plate shape along a surface orthogonal to the axial direction. According to the above configuration, it is possible to obtain the above described effect to suppress a temperature increase of the back surface 2*b* of the boss portion 2 with a simple configuration.

In some embodiments, as depicted in FIG. 2, in the compressor impeller 50 (50B), the heat shield portion 8 has a curved portion 16 having an annular shape which is curved toward the back surface 2*b* of the boss portion 2 outward in the radial direction. In an illustrative embodiment, the entire heat shield portion 8 is curved toward the back surface 2*b* of the boss portion 2 outward in the radial direction.

According to the above configuration, air is more likely to be retained on the radially inner side of the curved portion 16 having an annular shape, and the air in the gap 'g' is more likely to rotate with the boss portion 2 and the heat shield portion 8. Thus, it is possible to effectively reduce the friction between the back surface 2*b* of the boss portion 2 and the air in the gap 'g', and suppress a temperature increase of the air in the gap 'g'. Thus, it is possible to suppress heating of the back surface 2*b* of the boss portion 2 effectively.

Furthermore, to promote rotation of the air in the gap 'g' with the boss portion 2 and the heat shield portion 8, it is desirable to form the curved portion 16 having an annular shape in a range including at least a part of the radially outer portion 14 of the heat shield portion 8. In an illustrative embodiment, the entire heat shield portion 8 is curved toward the back surface 2*b* of the boss portion 2 outward in the radial direction.

In some embodiments, as depicted in FIG. 3, in the compressor impeller 50 (50C), the heat shield portion 8 has a protruding portion 18 having an annular shape which protrudes toward the back surface 2*b* of the boss portion 2.

According to the above configuration, air is more likely to be retained on the radially inner side of the protruding portion 18 having an annular shape, and the air in the gap 'g' is more likely to rotate with the boss portion 2 and the heat shield portion 8. Thus, it is possible to effectively reduce the friction between the back surface 2*b* of the boss portion 2 and the air in the gap 'g', and suppress a temperature increase of the air in the gap 'g'. Thus, it is possible to suppress heating of the back surface 2*b* of the boss portion 2 effectively.

Furthermore, to promote rotation of the air in the gap 'g' with the boss portion 2 and the heat shield portion 8, it is desirable to form the protruding portion 18 having an annular shape on the radially outer portion 14 of the heat shield portion 8. In the depicted illustrative embodiment, the protruding portion 18 is formed on the radially outer edge of the heat shield portion 8.

In some embodiments, in the compressor impeller 50 (50D) shown in FIG. 4, the heat shield portion 8 is a coating layer coating the back surface 2*b* of the boss portion 2, including a material having a lower thermal conductivity than the compressor impeller body portion 6. According to the above configuration, it is possible to achieve a light-weight heat shield portion 8 at low cost.

In some embodiments, as depicted in FIGS. 5 and 6, in the compressor impeller 50 (50E, 50F), the heat shield portion 8 is formed integrally with the compressor impeller body portion 6 from the same material, and the gap 'g' is an annular slit 12 disposed between the boss portion 2 and the heat shield portion 8.

According to the above configuration, the compressor impeller body portion 6 and the heat shield portion 8 rotate together, and thereby it is possible to rotate the air in the slit 12 between the boss portion 2 and the heat shield portion 8, with the back surface 2*b* of the boss portion 2 and the heat shield portion 8. Thus, the friction between the back surface 2*b* of the boss portion 2 and the air in the slit 12 is small, and the temperature of the air in the slit 12 is less likely to rise. Thus, it is possible to suppress heating of the back surface 2*b* of the boss portion 2 effectively. Furthermore, since the heat shield portion 8 is formed integrally with the compressor impeller body portion 6 from the same material, the heat shield portion 8 can be provided without increasing the number of components, which makes it possible to suppress a size increase and a cost increase of the compressor impeller 50.

In some embodiments, as depicted in FIGS. 1 to 6, in the compressor impeller 50 (50A to 50F), the distance R1 between the radially outer end 8*e* of the heat shield portion 8 and the rotational axis O of the compressor impeller 50 is not smaller than a half of the distance R2 between the radially outer end 2*e* of the back surface 2*b* of the boss portion 2 and the rotational axis O of the compressor impeller 50.

Figure 9:
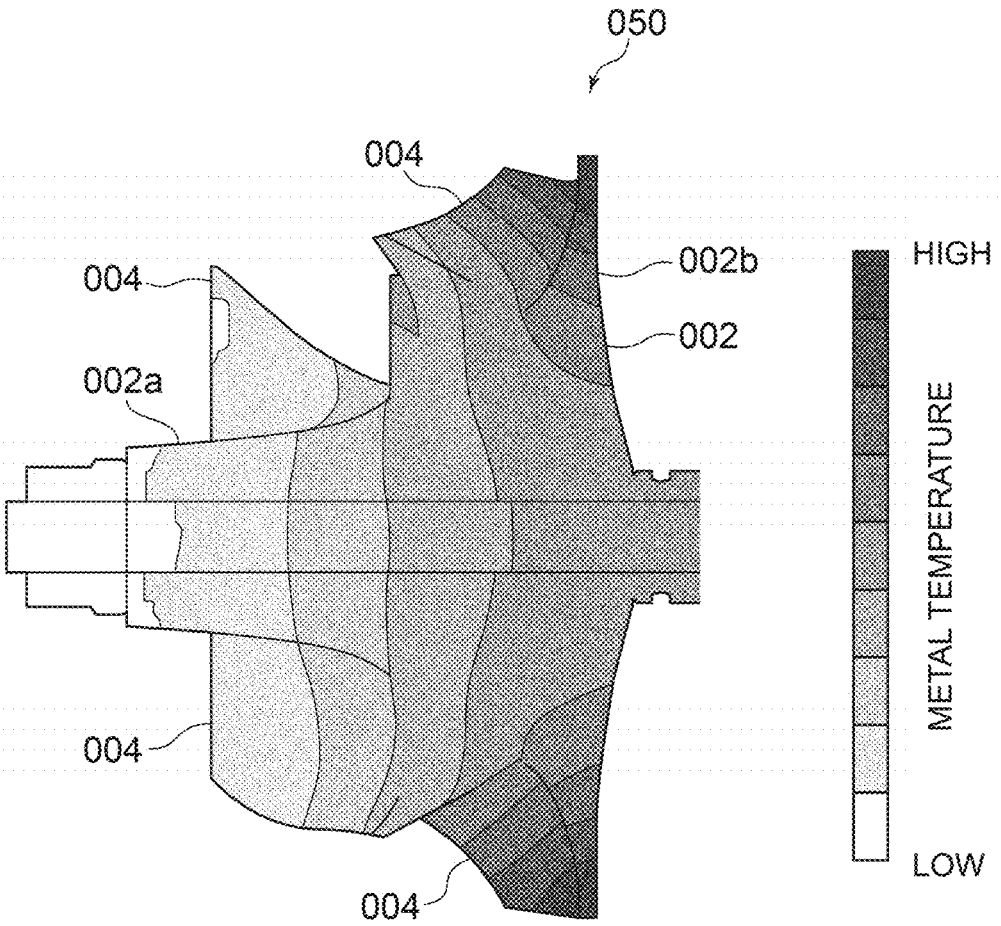
FIG. 9 is a diagram showing the distribution of the metal temperature of the compressor impeller 050 during operation of the compressor.

As depicted in FIG. 9, the temperature of the back surface of the boss portion tends to become relatively high at the radially outer portion of the boss portion. Thus, by setting the distance R1 to be not smaller than a half of the distance R2, it is possible to effectively suppress a temperature increase of the radially outer portion of the back surface 2*b* of the boss portion 2, where the temperature tends to rise, with the heat shield portion 8.

In some embodiments, as depicted in FIGS. 1 to 3, and 6, in the compressor impeller 50 (50A to 50F), the radially outer end 8*e* of the heat shield portion 8 is positioned on the inner side, with respect to the radial direction, of the radially outer end 2*e* of the back surface 2*b* of the boss portion 2.

Figure 8:
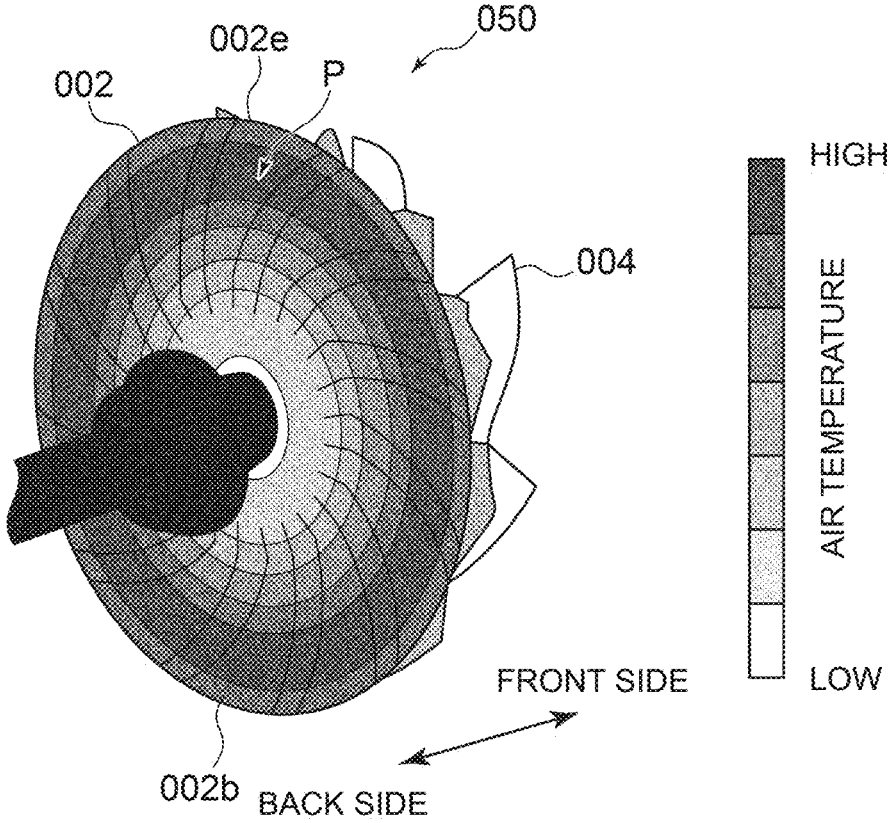
FIG. 8 is a diagram showing the distribution of air temperature in the gap on the back side (the gap in the axial direction between the back surface of the boss portion and the stationary portion of the casing or the like) of the boss portion 002 of the compressor impeller 050, during operation of a compressor.

According to findings of the present inventors, as depicted in FIG. 8, the temperature of air adjacent to the back surface of the boss portion 002 becomes highest at a radial directional position P on the inner side of the radially outer end 002*e* of the boss portion 002.

In this regard, with the compressor impeller 50 (50F) depicted in FIG. 6, the radially outer end 8*e* of the heat shield portion 8 is disposed on the inner side, with respect to the radial direction, of the radially outer end 2*e* of the back surface 2*b* of the boss portion 2, and thus it is possible to provide the slit 12 from the outer side to the inner side of the radial directional position P with the highest temperature, without increasing the depth 'd' of the slit 12 excessively in view of the strength of the compressor impeller. Thus, it is possible to suppress a temperature increase of the back surface 2*b* of the boss portion 2 effectively while ensuring the strength of the compressor impeller 50 (50F).

Embodiments of the present invention were described in detail above, but the present invention is not limited thereto, and various amendments and modifications may be implemented.

The present invention may be combined to the technique disclosed in Patent Document 1, that is, the technique of spraying high-pressure cooling air onto the back surface of the boss portion of the compressor impeller to cool the back surface of the boss portion. In this case, it is possible to reduce the flow rate of cooling gas required to cool the back surface of the boss portion of the compressor impeller to a certain standard, and thus it is possible to simplify the configuration of the supply flow passage for supplying cooling gas.

DESCRIPTION OF REFERENCE NUMERALS

2 Boss portion
2*a* Peripheral surface
2*b* Back surface
2*e* Radially outer end
4 Vane portion
4*a* Leading edge
6 Compressor impeller body portion
8 Heat shield portion
8*e* Radially outer end
10 Shaft portion
12 Slit
14 Radially outer portion
16 Curved portion
18 Protruding portion
50 Compressor impeller
O Rotational axis
P Position
R1, R2 Distance
g Gap

The invention claimed is:

1. A compressor impeller, comprising:

a compressor impeller body portion including a boss portion and a plurality of vane portions disposed at intervals in a circumferential direction on a peripheral surface of the boss portion; and a heat shield portion disposed on a side of a back surface of the boss portion and configured to rotate with the compressor impeller body portion, wherein the heat shield portion is formed to have an annular shape, wherein the heat shield portion is disposed so as to face the back surface of the boss portion via a gap, wherein the heat shield portion extends along a radial direction of the compressor impeller from an inner side toward an outer side of the boss portion, wherein the heat shield portion includes a curved portion curved so as to become closer to the back surface of the boss portion outward in the radial direction of the compressor impeller, the curved portion being curved so as to be convex in a direction away from the back surface of the boss portion, and wherein the gap is in communication with a space on an outer side of the heat shield portion with respect to a radial direction of the compressor impeller.

2. The compressor impeller according to claim 1, wherein the heat shield portion is formed of a different material from the compressor impeller body portion.

3. The compressor impeller according to claim 2, wherein the heat shield portion is formed of a material having a lower thermal conductivity than the compressor impeller body portion.

4. The compressor impeller according to claim 1, wherein the heat shield portion is made of sheet metal.

5. A compressor impeller, comprising:

a compressor impeller body portion including a boss portion and a plurality of vane portions disposed at intervals in a circumferential direction on a peripheral surface of the boss portion; and a heat shield portion disposed on a side of a back surface of the boss portion and configured to rotate with the compressor impeller body portion, wherein the heat shield portion is formed to have an annular shape, wherein the heat shield portion is disposed so as to face the back surface of the boss portion via a gap, wherein the heat shield portion extends along a radial direction of the compressor impeller from an inner side toward an outer side of the boss portion, wherein the heat shield portion includes a protruding portion having an annular shape and protruding toward the back surface of the boss portion, and wherein the gap is in communication with a space on an outer side of the heat shield portion with respect to a radial direction of the compressor impeller.

6. The compressor impeller according to claim 5, wherein the heat shield portion is formed of a different material from the compressor impeller body portion.

7. The compressor impeller according to claim 6, wherein the heat shield portion is formed of a material having a lower thermal conductivity than the compressor impeller body portion.

8. The compressor impeller according to claim 5, wherein the heat shield portion is made of sheet metal.

* * * * *